US006636134B2

(12) United States Patent
Holaus et al.

(10) Patent No.: US 6,636,134 B2
(45) Date of Patent: Oct. 21, 2003

(54) HIGH-SPEED MECHANICAL SWITCHING POINT

(75) Inventors: Walter Holaus, Zürich (CH); Samuele Sartori, Moghegno (CH); Michael Steurer, Tallahassee, FL (US); Klaus Fröhlich, Baden (CH); Kurt Kaltenegger, Lengnau (CH)

(73) Assignee: ABB Schweiz AG, Baden (CH)

( * ) Notice: Subject to any disclaimer, the term of this patent is extended or adjusted under 35 U.S.C. 154(b) by 147 days.

(21) Appl. No.: 09/929,029

(22) Filed: Aug. 15, 2001

(65) Prior Publication Data

US 2002/0056703 A1 May 16, 2002

(30) Foreign Application Priority Data

Aug. 15, 2000 (EP) ..... 00810722

(51) Int. Cl.[7] ..... H01H 53/00; H01F 7/08
(52) U.S. Cl. ..... 335/147; 335/225
(58) Field of Search ..... 335/147, 148, 335/149, 150, 223, 224, 225, 226

(56) References Cited

U.S. PATENT DOCUMENTS 1,759,933 A * 5/1930 Bonell ..... 335/148
4,134,090 A * 1/1979 Schuessler et al. ..... 335/229
5,313,180 A 5/1994 Vial et al.
5,534,832 A * 7/1996 Duchemin et al. ..... 335/16
6,396,369 B1 * 5/2002 Schlitz et al. ..... 335/16
6,426,688 B1 * 7/2002 DeVizzi et al. ..... 335/16

FOREIGN PATENT DOCUMENTS

| | | | | |
|---|---|---|---|---|
| DE | 3440229 A1 * | 8/1985 | ..... | H01H/50/02 |
| DE | 19629867 A1 | 2/1998 | | |
| EP | 133809 A2 * | 3/1985 | ..... | H01H/71/10 |
| EP | 0147036 A1 | 7/1985 | | |
| EP | 0810722 A2 | 12/1997 | | |
| EP | 0810722 A3 | 5/1999 | | |
| EP | 0810722 B1 | 12/2002 | | |
| FR | 1168235 | 12/1958 | | |

* cited by examiner

*Primary Examiner*—Elvin Enad
*Assistant Examiner*—Bernard Rojas
(74) *Attorney, Agent, or Firm*—Burns, Doane, Swecker & Mathis, L.L.P.

(57) ABSTRACT

The switching point in a high- or medium-voltage switch contains two fixed contact members (1, 2), a rotating, electrically conductive bridging contact member (3), and a drive for moving the bridging contact member (3). When the switching point is closed, the bridging contact member (3) is fit in between the fixed contact members (1, 2) and short-circuits them. The drive is composed of two coils (5, 6) which surround the bridging contact member (3) and are arranged in such a manner that the bridging contact member (3) can be caused to rotate by a current in a respective one of the coils. The energy which needs to be applied to rotate the bridging contact member is less than for contact members which move in translation in comparable switching points. The energy required for opening and closing the switching point is thus reduced.

5 Claims, 3 Drawing Sheets

HIGH-SPEED MECHANICAL SWITCHING POINT

FIELD OF THE INVENTION

The invention relates to high- or medium-voltage switches, and more particularly to switching points for such switches.

BACKGROUND OF THE INVENTION

Switches for high- or medium-voltage level have mechanical connectors or mechanical disconnectors with an arc duration of at most a few hundred microseconds.

Such a switching point is described in the prior European Patent Application File Reference 99810596.9.

The switching point in a high- or medium-voltage switch contains two fixed contact members, which are cylindrical and, inserted coaxially into one another, form an annular gap. A moving, bridging contact member in the form of a contact ring is fit in the annular gap when the switching point is closed. Coils of an electrodynamic drive are arranged on both sides of the contact ring, in order to move the contact ring in the axial direction.

In order to open the switching point, a current is fed into one of the two coils. Eddy currents are induced in the contact ring, and are essentially in the opposite direction to the current in the coil. The coil and contact ring are thus forced apart from one another, which leads to a translational acceleration of the contact ring, and thus to opening of the switching point.

In order to close the switching point, the current is fed into the other of the two coils, in response to which the contact ring moves back to the original position again, and the switching point is thus closed once again.

SUMMARY OF THE INVENTION

An object of the invention is to provide a switching point of the type mentioned initially, which can be opened and closed quickly and with little energy being required.

When the switching point is closed, a bridging contact member in the form of a disk short-circuits two fixed contact members in the rated current direction. The bridging contact member is arranged such that it can rotate about its own center axis, running at right angles to the rated current direction. The eddy currents which are required to form a couple for an electrodynamic rotary contact drive are induced in the moving bridging contact member.

The energy which needs to be applied to rotate the bridging contact member is less than for contact members which move in translation, in comparable switching points. The energy required for opening and closing the switching point is thus reduced.

The switching point with the rotating contact member can be utilized more optimally dielectrically, since the fixed contact members can be designed to be rounder than in the case of switching points with contact members which move in translation.

During opening, two contact gaps are formed, each of which is bridged by one of two arc elements, which are in series. This connection of arc elements in series increases the arc voltage dropped across a contact arrangement of the switching point, which in turn allows commutation particularly quickly and effectively when there is a susceptible parallel path.

BRIEF DESCRIPTION OF THE DRAWINGS

A preferred embodiment of the invention is described in more detail in the following text with reference to the accompanying drawings, in which.

DETAILED DESCRIPTION OF THE INVENTION

The same reference symbols relate to parts having the same effect in all the figures.

Figure 1:
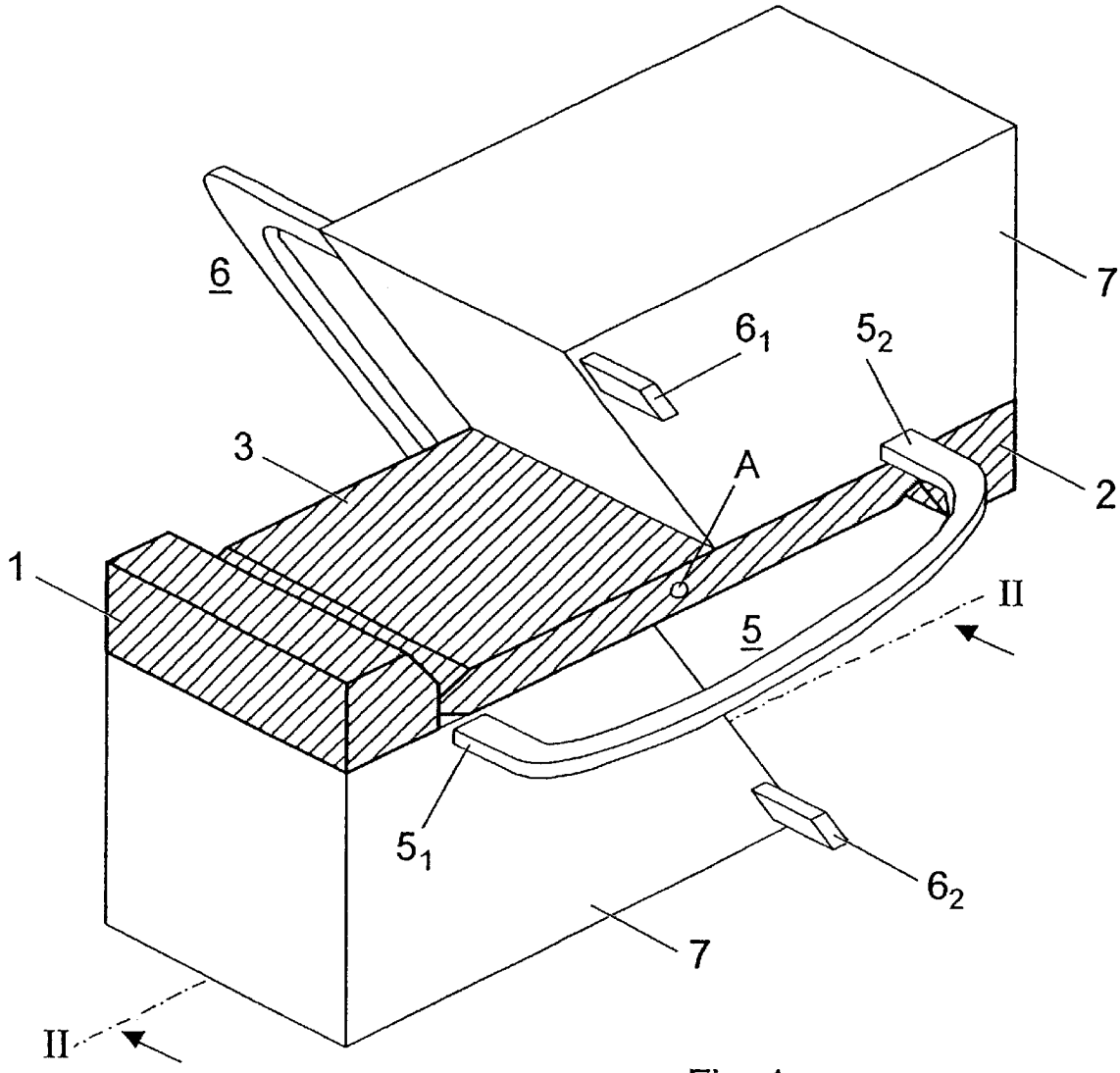
FIG. 1 shows a view of a switching point according to the invention in the closed state, with two fixed contact members and a bridging contact member in between them.

FIG. 1 shows one embodiment of the switching point according to the invention for a high- or medium-voltage switch for a rated current $I_N$ in the range from ten to several thousand amperes.

When the switching point is closed, the fixed contact members 1 and 2 together with the electrically conductive bridging contact member 3 form the rated current path $I_N$. The bridging contact member is in the form of a disk and is fit between the two fixed contact members. The bridging contact member 3 is mounted such that it can rotate about the center axis A at right angles to the rated current direction $I_N$. The bridging contact member 3 is manufactured from a light alloy, in particular aluminum. The contact points for the fixed contact members 1 and 2 are preferably formed from good electrical contact materials, for example silver. The distance between the fixed contact members 1 and 2 is between ten and several tens of millimeters.

The cross section at right angles to the rated current direction of the bridging contact 3 is governed by the rated current $I_N$ and by the maximum permissible current density in the bridging contact member. The length in the rated current direction, and thus the distance between the two fixed contact members 1 and 2, is governed by the maximum voltage that occurs during operation, and by the insulating medium used. Possible insulating media are air or sulfur hexafluoride at atmospheric pressure, or at a raised pressure.

An electrodynamic drive comprising two coils 5 and 6 is provided in order to move the bridging contact member 3. The first coil 5 is intended for opening the switching point, and the second coil 6 for closing the switching point. The coils surround the bridging contact member 3 and contain a number of turns (for example 6–8).

The coils for opening the switching point 5 passes underneath the bridging contact member on one side of the center axis A, and above it on the other side. These two coil sections $\mathbf{5}_1$ and $\mathbf{5}_2$, which run parallel to the center axis A, are not mechanically connected to the bridging contact member 3 and, furthermore, are electrically insulated from it. In order to ensure an optimum drive with as little energy as possible, the coil sections $\mathbf{5}_1$ and $\mathbf{5}_2$ are arranged as close as possible to the bridging contact member 3, and in the region of those ends of the bridging contact 3 which face the fixed contact members 1 and 2, when the switching point is closed.

The coil for closing the switching point 6 is likewise passed above the bridging contact member on one side of the center axis A, and underneath it on the other side. These two coil sections $\mathbf{6}_1$ and $\mathbf{6}_2$, which run parallel to the center axis A, are likewise not mechanically connected to the bridging contact member 3, and are electrically insulated from it. In order to ensure an optimum drive with as little energy as possible, the coil sections $\mathbf{6}_1$ and $\mathbf{6}_2$ are arranged as close as possible to the bridging contact member 3, and likewise in the region of the ends of the bridging contact member 3, when the switching point is open.

The two coils 5 and 6 are designed essentially to be mirror images with respect to the bridging contact member, and are arranged such that they rotate offset about the center axis A. The coil sections $\mathbf{5}_1$ and $\mathbf{6}_1$, together with $\mathbf{5}_2$ and $\mathbf{6}_2$, essentially bound the rotational movement range of the bridging contact member 3. The coils 5 and 6 may be designed to be sufficiently broad that they act virtually over the entire bridging contact member. For example, the width of the coil 5 may extend from the fixed contact member 1 to the rotation axis A.

The entire switching point is held together by insulation bodies 7, and, in particular, each respective fixed contact member 1 or 2 is firmly connected to the corresponding coil sections on the same side of the respective bridging contact member $\mathbf{5}_1$ and $\mathbf{6}_2$ or $\mathbf{5}_2$ and $\mathbf{6}_1$, by means of an insulation body 7.

Figure 5:
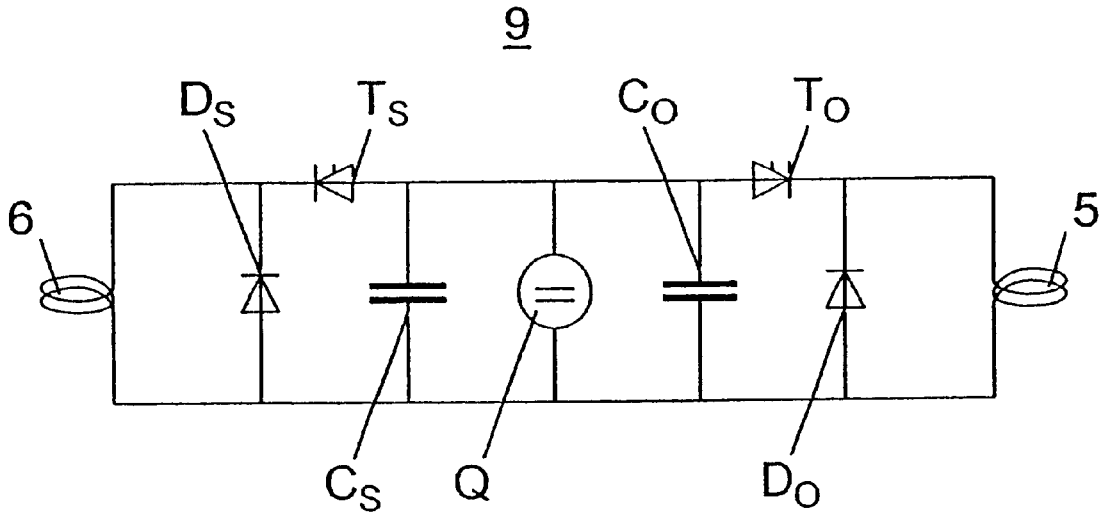
FIG. 5 shows a schematic illustration of the control electronics for controlling the switching point shown in FIG. 1.

A power-electronic control unit 9, such as that illustrated in FIG. 5, is provided for driving the coils 5 and 6. The control unit 9 essentially contains a charging device Q, one drive capacitor $C_O$ or $C_S$, respectively, per coil, and a respective thyristor $T_O$ or $T_S$. In addition, in order to improve the drive efficiency, a respective free wheeling diode $D_O$ or $D_S$ can also be inserted into the drive circuit. Other, more complex circuits may also be used for the control unit 9, of course. Such circuits may also be found in the cited application EP 99810596.9.

Figure 2:
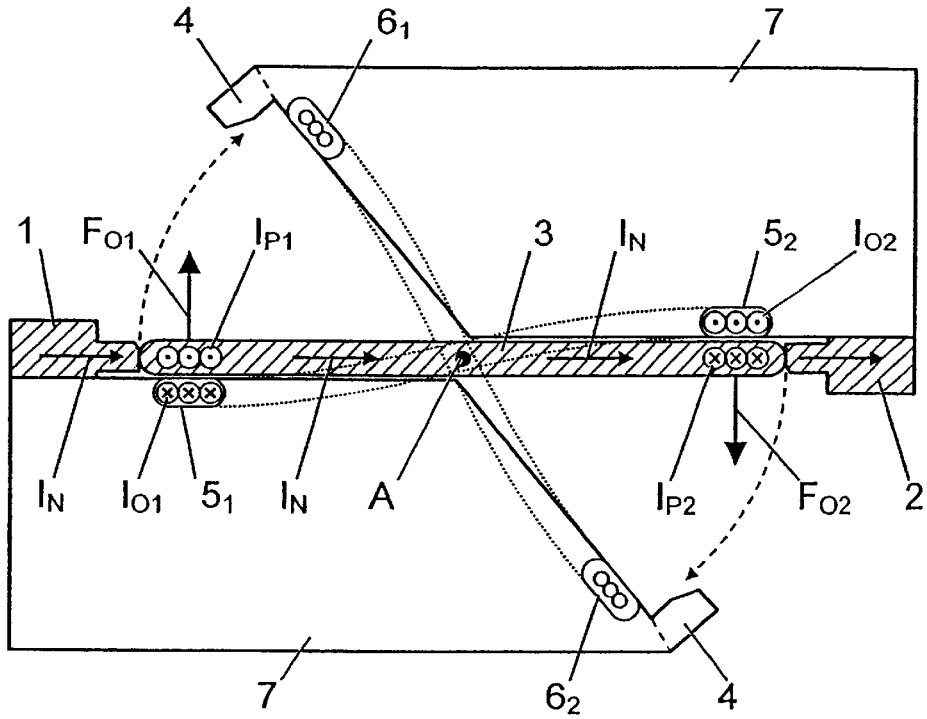
FIG. 2 shows a view in the direction of the arrow of a section along II—II through the switching point shown in FIG. 1 in the closed state, during opening of the switching point.

FIG. 2 shows the opening process for the switching point. The bridging contact member 3 is fit between the fixed contact members. In order to initiate the opening movement of the bridging contact member 3, the drive capacitor $C_O$ is discharged via the coil 5. The resultant drive current $I_O$ is typically one half-cycle with a peak current of several thousand amperes at a frequency of several thousand Hertz. As can be seen from FIG. 2, the drive current flows to the rear ($I_{O1}$) in the lower coil section $\mathbf{5}_1$, and forward ($I_{O2}$) in the upper coil section $\mathbf{5}_2$. In the process, eddy currents are induced in the bridging contact member 3 through which the rated current $I_N$ is still flowing, and these are essentially in the opposite direction to the drive current. The eddy currents $I_{P1}$ caused by the drive current flowing to the rear in the lower coil section $I_{O1}$ thus flow forward, and the eddy currents $I_{P2}$ caused by the drive current flowing forward in the lower coil section $I_{O2}$ flow to the rear. While the current is flowing in the coil, it results in a repulsion force acting between the coil sections $\mathbf{5}_1$ and $\mathbf{5}_2$ and the bridging contact member 3. The resultant couple $F_{O1}$ and $F_{O2}$ causes the bridging contact member 3 to rotate clockwise. The bridging contact member 3 is detached from the fixed contact members 1 and 2, and rotates about the center axis A, forming two arcs. After a specific rotation angle, the bridging contact member is first of all braked, for example by mechanical friction from a mechanical braking and holding apparatus 4, and is then held fixed. The switching point has thus reached the open state. The rotation angle is governed by the dielectric strength to be achieved and is in the range from 30 to 90°, preferably approximately 60°.

Figure 4:
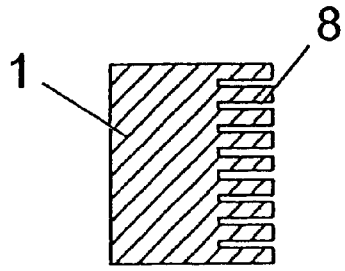
FIG. 4 shows a view in the direction of the arrow of a section along IV—IV through a fixed contact member of the switching point shown in FIG. 3.

In order to prevent the formation of eddy currents in the fixed contact members 1 and 2, the contact members are provided with slots 8 in the region facing the bridging contact member. FIG. 4 shows a fixed contact member 1 with slots 8. The slots 8 are longer than the penetration depth of the magnetic field of the drive current in the material of the fixed contact member 1. The formation of eddy currents in the fixed contact members can thus be avoided.

Figure 3:
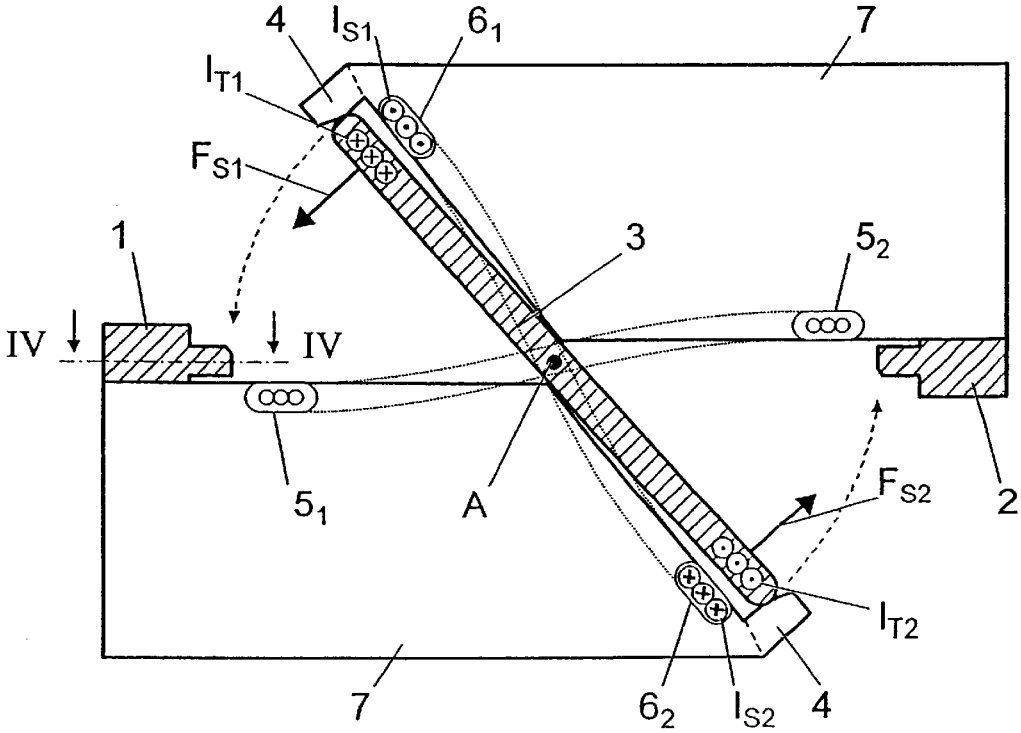
FIG. 3 shows a view of the switching point shown in FIG. 2 in the open state, during closing of the switching point.

FIG. 3 shows the closing process of the switching point. The bridging contact member 3 is held by the holding apparatus 4. In order to initiate the closing movement of the bridging contact member 3, the drive capacitor $C_S$ is discharged via the coil 6. The resultant drive current $I_S$ is typically one half-cycle with a peak current of several thousand amperes and at a frequency of several thousand Hertz. As can be seen from FIG. 3, the drive current in the lower coil section $\mathbf{6}_2$ flows to the rear ($I_{S2}$) and that in the upper coil section $\mathbf{6}_1$ flows forward ($I_{S1}$). In the process, eddy currents are once again induced in the bridging contact member 3 and are essentially in the opposite direction to the drive current. The eddy currents $I_{T2}$ which are caused by the drive current flowing to the rear in the lower coil section $I_{S2}$ thus flow forward, and the eddy currents $I_{T1}$ which are caused by the drive current flowing forward in the upper coil section $I_{S1}$ flow to the rear. While the current is flowing in the coil, it results in a repulsion force acting between the coil sections $\mathbf{6}_1$ and $\mathbf{6}_2$ and the bridging contact member 3. The resultant couple $F_{S1}$ and $F_{S2}$ causes the bridging contact member 3 to rotate counterclockwise. The bridging contact member 3 is detached from the holding apparatus 4 and rotates about the center axis A. The bridging contact member 3 rotates until it is braked by the fixed contact member, and is then held firmly. The switching point is closed once again, and the rated current $I_N$ flows through the bridging contact member 3.

List of Reference Symbols

1,2 Fixed contact members
3 Bridging contact members
4 Holding apparatus
5 Drive coil for opening the switching point
$\mathbf{5}_1$, $\mathbf{5}_2$ Coil sections running parallel to the center axis
6 Drive coil for closing the switching point
$\mathbf{6}_1$, $\mathbf{6}_2$ Coil sections running parallel to the center axis
7 Insulation body
9 Power-electronic control unit
A Center axis, rotation axis
$C_O$, $C_S$ Drive capacitors
$D_O$, $D_S$ Freewheeling diodes
$F_{O1}$, $F_{O2}$ Force on the bridging contact member during opening of the switching point
$F_{S1}$, $F_{S2}$ Force on the bridging contact member during closing of the switching point
$I_N$ Rated current direction
$I_{O1}$, $I_{O2}$ Drive current for opening the switching point
$I_{P1}$, $I_{P2}$ Eddy currents induced during opening of the switching point
$I_{S1}$, $I_{S2}$ Drive current for closing the switching point
$I_{T1}$, $I_{T2}$ Eddy currents induced during closing of the switching point
Q Charging device
$T_O$, $T_S$ Thyristor

What is claimed is:

1. A switching point for a high- or medium-voltage switch, containing two fixed contact members, a moving, electrically conductive bridging contact member which, when the switching point is closed, is fit in between the fixed contact members and short-circuits them in the rated current direction, and a drive for moving the bridging contact member, which comprises at least two coils, which are arranged such that they at least partially bound the movement range of the bridging contact member, and a power-electronic control unit for supplying the coils, wherein the fixed contact members are designed and arranged essentially symmetrically with respect to one another with respect to a center axis of the bridging contact member running at right angles to the rated current direction, and wherein the bridging contact member is arranged such that it can rotate about the center axis in order to open and close the switching point.

2. The switching point as claimed in claim 1, wherein the bridging contact member is extended in the form of a plate in the rated current direction and in the direction of the center axis.

3. The switching point as claimed in claim 1, wherein two coil sections, which are electrically insulated from the bridging contact member and run parallel to the center axis, of a first of the two coils are each arranged, with respect to the bridging contact member when the switching point is closed, in the region of opposite ends of the bridging contact member and offset on opposite sides of the bridging contact member in the opposite direction to the direction in which the bridging contact member rotates during opening of the switching point, and wherein two coil sections, which are electrically insulated from the bridging contact member and run parallel to the center axis, of the second coil are each arranged, with respect to the bridging contact member when the switching point is open, in the region of opposite ends of the bridging contact member and offset on opposite sides of the bridging contact member in the direction in which the bridging contact member rotates during opening of the switching point.

4. The switching point as claimed in claim 1, wherein a holding apparatus for fixing the bridging contact member in the open state of the switching point is arranged in the region of the coil which bounds the movement range of the bridging contact member during opening of the switching point.

5. The switching point as claimed in claim 1, wherein the fixed contact members each have at least one slot which runs away from the bridging contact member in the rated current direction.

* * * * *